US006416431B1

(12) United States Patent
Keehn, Sr. et al.

(10) Patent No.: US 6,416,431 B1
(45) **Date of Patent: *Jul. 9, 2002**

(54) BASKETBALL SAFETY RETURN II

(76) Inventors: Gorman E. Keehn, Sr., 74 Shenandoah Dr., Sicklerville, NJ (US) 08081; Joseph J. Connelly, 918 E. Clements Bridge Rd. Apt. C-5, Runnemede, NJ (US) 08078

( * ) Notice: Subject to any disclaimer, the term of this patent is extended or adjusted under 35 U.S.C. 154(b) by 0 days.

This patent is subject to a terminal disclaimer.

(21) Appl. No.: 09/587,252

(22) Filed: Jun. 2, 2000

(51) Int. Cl.[7] ..... A63B 67/00
(52) U.S. Cl. ..... 473/472; 473/451
(58) Field of Search ..... 473/472, 473, 473/476, 451, 447

(56) References Cited

U.S. PATENT DOCUMENTS

| | | | | |
|---|---|---|---|---|
| 4,941,663 A | | 7/1990 | Walker | 273/29 |
| 4,948,149 A | | 8/1990 | Lin | 273/411 |
| 4,948,150 A | | 8/1990 | Daly, Jr. | 273/411 |
| 5,180,143 A | | 1/1993 | Brower | 256/24 |
| 5,326,109 A | | 7/1994 | Robl | 273/411 |
| 5,402,999 A | * | 4/1995 | Keehn | 473/472 |
| 5,467,990 A | * | 11/1995 | Kitzhaber | 473/164 |
| 5,492,319 A | | 2/1996 | Lee | 273/181 |
| 5,664,769 A | | 9/1997 | Sudinsky | 256/73 |
| 5,664,784 A | | 9/1997 | Redlich | 273/396 |
| 5,730,666 A | | 3/1998 | Hudson | 473/421 |
| 5,785,616 A | * | 7/1998 | Dodge | 473/479 |
| 5,816,956 A | | 10/1998 | Ellis | 473/4.9 |
| 6,149,135 A | | 11/2000 | Hlavin | 256/24 |

* cited by examiner

*Primary Examiner*—Paul T. Sewell
*Assistant Examiner*—M. Chambers
(74) *Attorney, Agent, or Firm*—John H. Scarborough; Robert R. Mallinckrodt

(57) ABSTRACT

A basketball safety apparatus which comprises sections of netting adapted to be used in conjunction with a basketball goal, movable pole support bases which are adapted to be positioned in proximity to the basketball goal and a driveway that connects to a street, and a plurality of poles adapted to be mounted vertically in the pole support bases. The sections of netting are connected to the vertically mounted poles or to the basketball goal. The netting has mesh size is sufficiently small to stop a basketball, and the poles and bases are mounted and arranged so that the netting forms a barrier in one or more directions from the basketball goal and across the driveway.

21 Claims, 16 Drawing Sheets

BASKETBALL SAFETY RETURN II

BACKGROUND OF THE INVENTION

1. Field

This invention is in the field of basketball safety return apparatuses.

2. Background of the Invention

Safety of children and adults is an extremely important goal for society. Recreation is also an important activity in American life. This invention provides a measure of safety when using a driveway as a basketball court. This invention provides netting around a basketball goal in order to help prevent a basketball from rolling into a street during a recreational basketball game. This netting connected to poles and arranged such that at least one section of netting is positioned to form a barrier across a driveway to help prevent a basketball from rolling into the street and other sections of netting positioned to help prevent the basketball from wandering into a neighbor's yard and to eliminate the need the chase a basketball for great distances for retrieval. This netting can be attached to and supported by vertical poles or can be arranged such that the netting can be attached to and supported by the basketball goal post itself. Further, adjacent sections of netting can be sewn together by pieces of cloth which act as sleeves which would fit over the vertical support poles.

3. State of the Art

Keehn, U.S. Pat. No. 5,402,999, provides similar protection. However, Keehn only provides for netting which is approximately the same height of the basketball goal. In this invention, the netting only need to be about half the height of the netting as required in Keehn, thereby saving great amounts of material costs for a consumer.

Further, in Keehn, the patent only provides for netting to be supported by and connected to vertical support poles only. In this invention, the basketball goal itself can be used to connect sections of netting, thereby eliminating the need for an extra vertical support pole.

Still further, Keehn provides that sections of netting be connected to each other by connecting said sections of netting to the vertical support poles by fasteners. Whereas, in this invention, sections of netting can be connected to two rectangular pieces of cloth which, in turn, act as sleeves which fit over the vertical support poles to ease the task of assembling the netting and vertical support poles.

Ellis, U.S. Pat. No. 5,816,956, simply a net support structure, comprises a tubular frame, tensioning cord, and netting. of the positions of the corners of bumpers when driving or parking a vehicle.

Hudson, U.S. Pat. No. 5,730,666, is a portable screen connected to poles.

Robl, U.S. Pat. No. 5,326,109, is a portable net holding assembly for volley ball.

Brower, U.S. Pat. No. 5,190,143, is a portable sport boundary fence comprising tubular posts, bases to anchor posts, and netting for establishing temporary boundaries for sporting events.

Lin, U.S. Pat. No. 4,948,149, applies portable net posts for connecting netting for ball games. The posts are comprised of pipes of various diameters.

Daly, U.S. Pat. No. 4,948,150, is a volleyball practice comprising a means for holding a volley ball system net holding assembly for volley ball.

Redlich, U.S. Pat. 5,664,784, is a rebound net system for sport balls comprising essentially a netting that fits over a garage door opening the net to prevent basketballs from going into the garage.

Lee, U.S. Pat. No. 5,492,319, is an indoor chip shot practice device comprising a frame and netting.

Sudinsky, U.S. Pat. No. 5,664,769, is a swimming pool and spa tensioned protective fence with auto likable gate comprising.

Walker, U.S. Pat. No. 4,941,663, is a tennis service catching net comprising a tennis net, and a tennis ball catching net held by tubular supports.

It is believed that there exist products having netting which stretch across driveways. It is not believed that such devices are patented.

However, none of the prior art provides a safety apparatus in conjunction with a basketball goal post in proximity to a driveway to prevent a basketball from rolling into the street which provides for variable height vertical poles, netting which can be attached to the goal post itself, and sleeves which connect sections of netting and which fit over the vertical poles.

OBJECTS OF THE INVENTION

The primary object of this invention is to provide a safe measure when utilizing a basketball goal in conjunction with a driveway which leads to a street.

Another object of this invention is to eliminate the need for excess netting necessary to provide safety when using a basketball goal in conjunction with a driveway and to eliminate the need for additional vertical support poles.

Another object of this invention is to prevent a basketball from going into a neighbor's yard in order to prevent destruction of a neighbor's flowers, shrubbery, or lawn.

Another object of this invention is to provide a means to contain the basketball within the playing area and to eliminate the need the chase a basketball for great distances for retrieval.

Still another object of this invention is to make assembly and disassembly easy, even for a young child.

SUMMARY OF THE INVENTION

In the preferred embodiment, three sections of netting surround a basketball goal post; two sections serve as a backdrop behind the basketball goal post, and one section forms a barrier across a driveway leading to a street. In this preferred embodiment, three vertical poles and the basketball goal post support and connect the three sections of netting; the basketball goal post itself provides the other necessary connection. In an alternate embodiment, an additional vertical pole is provided in order to locate the netting further behind the basketball goal post to support and connect the netting.

A typical rubber or plastic basketball does not exhibit the elastic properties of a steel ball or a highly-packed, high-density rubber ball; therefore, the netting remote from the basketball goal post does not always have to be a high as that provided by Keehn. It can be a low as five-and-one-half feet. In this preferred embodiment, the netting only needs to be as high as the basketball goal at only one point; i.e., immediately behind the goal post. Netting across the driveway only needs to be half that height or approximately five-and-one-half feet.

Sleeves are provided to connect sections of netting to vertical support poles. With sleeves, assembly of the basketball safety apparatus is eased considerably. The time necessary to assemble the basketball safety apparatus having sleeves as connectors is less than having fasteners as connectors.

With the exception of Keehn, none of the prior art addresses the issue of basketball safety in a residential setting. None of the prior art provides for variable height netting, netting which attaches to the basketball goal post, or provides for easy assembly by use of sleeves between sections of netting.

BRIEF DESCRIPTION OF THE DRAWINGS

The best mode presently contemplated for carrying out the invention in actual practice is shown in the accompanying drawings, in which.

DETAILED DESCRIPTION OF THE ILLUSTRATED EMBODIMENT

Figure 1:
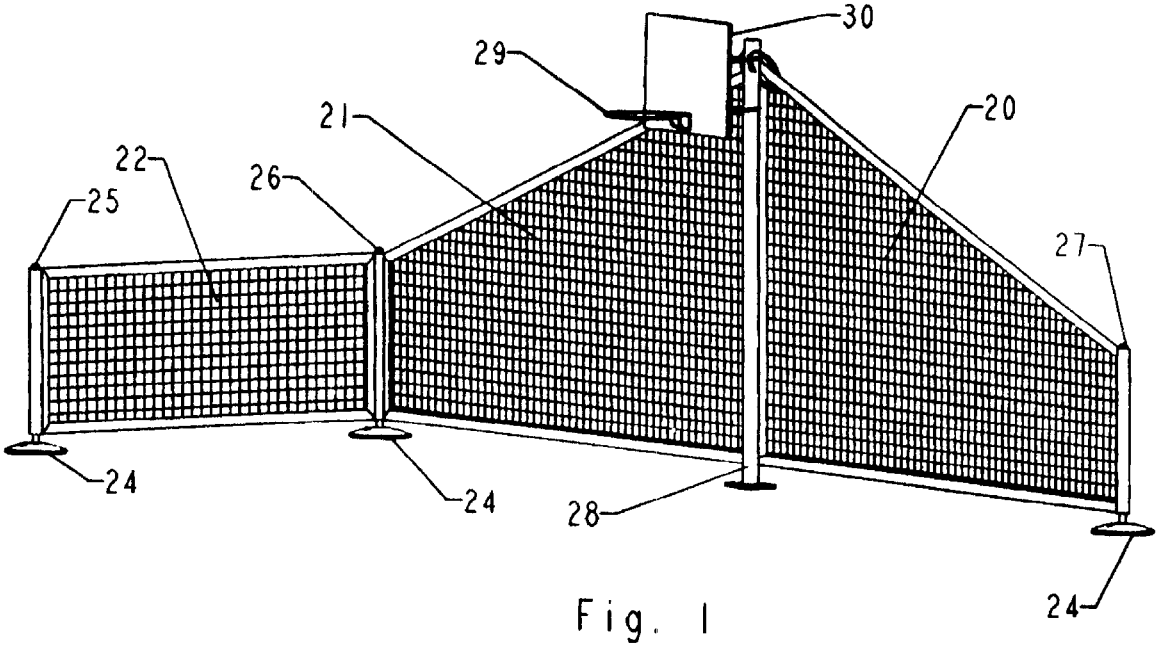
FIG. 1 is a perspective view of the basketball safety apparatus, a netting structure attached to a basketball goal post.
Figure 2:
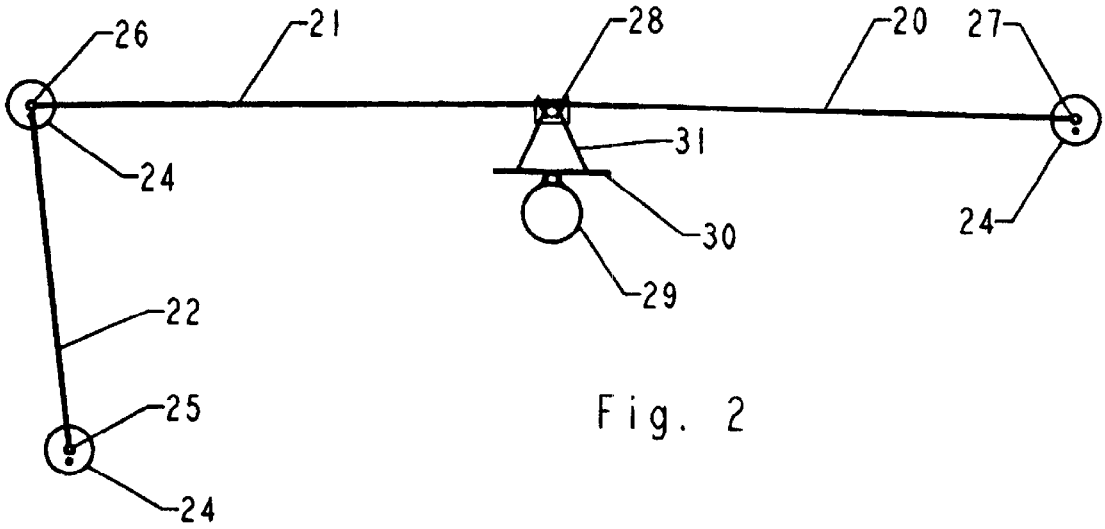
FIG. 2 is a schematic plan view of the preferred embodiment of the basketball safety apparatus where the netting is attached to the basketball goal post.

In the illustrated embodiment, FIG. 1 shows the basketball safety return apparatus where sections of netting 20 and 21 form a backdrop behind a basketball backboard support post 28 (typically referred to as a basketball goal post). Another section of netting 22 intended to form a barrier across a driveway leading to a street is situated to the left of the basketball goal post 28, as shown in FIG. 1.

In the preferred embodiment, adjacent sections of netting 21 and 22 which form a backdrop behind the basketball goal post 28 are connected to and supported by the basketball goal post 28, FIGS. 2, 5 through 8, and 16. In an alternate embodiment, the adjacent sections of netting 21 and 22 forming the backdrop behind the goal post 28 are connected to and supported by another vertical pole 58, FIGS. 12, 13, and 17.

Sections of netting are quadrilateral (i.e., four-sided) in shape. In the embodiments herewith illustrated, the sections of netting 20 and 21 located behind the backboard 30 are trapezoidal in shape, FIG. 1. The section of netting 22 forming a barrier across a driveway is rectangular in shape FIG. 1. It should be understood that the sections of netting could all be rectangular in shape with height reaching up to approximately 11 feet depending on the needs of the user of this invention. The basketball goal (or hoop) 29 and the backboard 30 are also shown in FIG. 1. It should also be understood that the section of netting 22 also can be situated to the right of the basketball goal post 28 in a situation where it would be appropriate to place it there. In the embodiment shown, the two sections of netting 20 and 21 reach a height of approximately 11 feet immediately behind the backboard 30 down to a height of approximately five-and-one-half feet at their distal end points, FIG. 1, in order to contain the basketball within the immediate playing area. The height of the section of netting forming the barrier across the driveway 22 is also approximately five-and-one-half feet. Sections of netting 20 and 21 are respectively orthogonal (i.e., forming approximate right angles) to each other. This angle can vary depending on the arrangement of the driveway with respect to location of the basketball goal post.

Vertical poles 25, 26, and 27, mounted in movable bases 24, are approximately five-and-one-half feet in height, FIGS. 1, 3, 4, 14, and 15. In the embodiment shown, vertical pole 25 is connected to and supports an end of section of netting 22, FIGS. 1, 3, and 14; vertical pole 26 is connected to and supports adjacent sections of netting 21 and 22, FIGS. 1, 4, and 15; vertical pole 27 is connected to and supports an end of section of netting 20, FIG. 1; and vertical pole 58 connects and supports adjacent sections of netting 20 and 21, FIGS. 13 and 17. It should be understood that the illustrations of vertical pole 25 connected to the end of section of netting 22, FIGS. 3 and 14, also apply to vertical pole 27 connected to the end of section of netting 20. It also should be understood that vertical poles 25, 26, and 27, could be comprised of two lengths of piping approximately five-and-one-half feet in length. Further, it also should be understood that there can be any number of sections of netting connected to and supported by any number of vertical poles mounted in movable bases depending on the requirements of the location of the basketball goal post.

Figure 13:
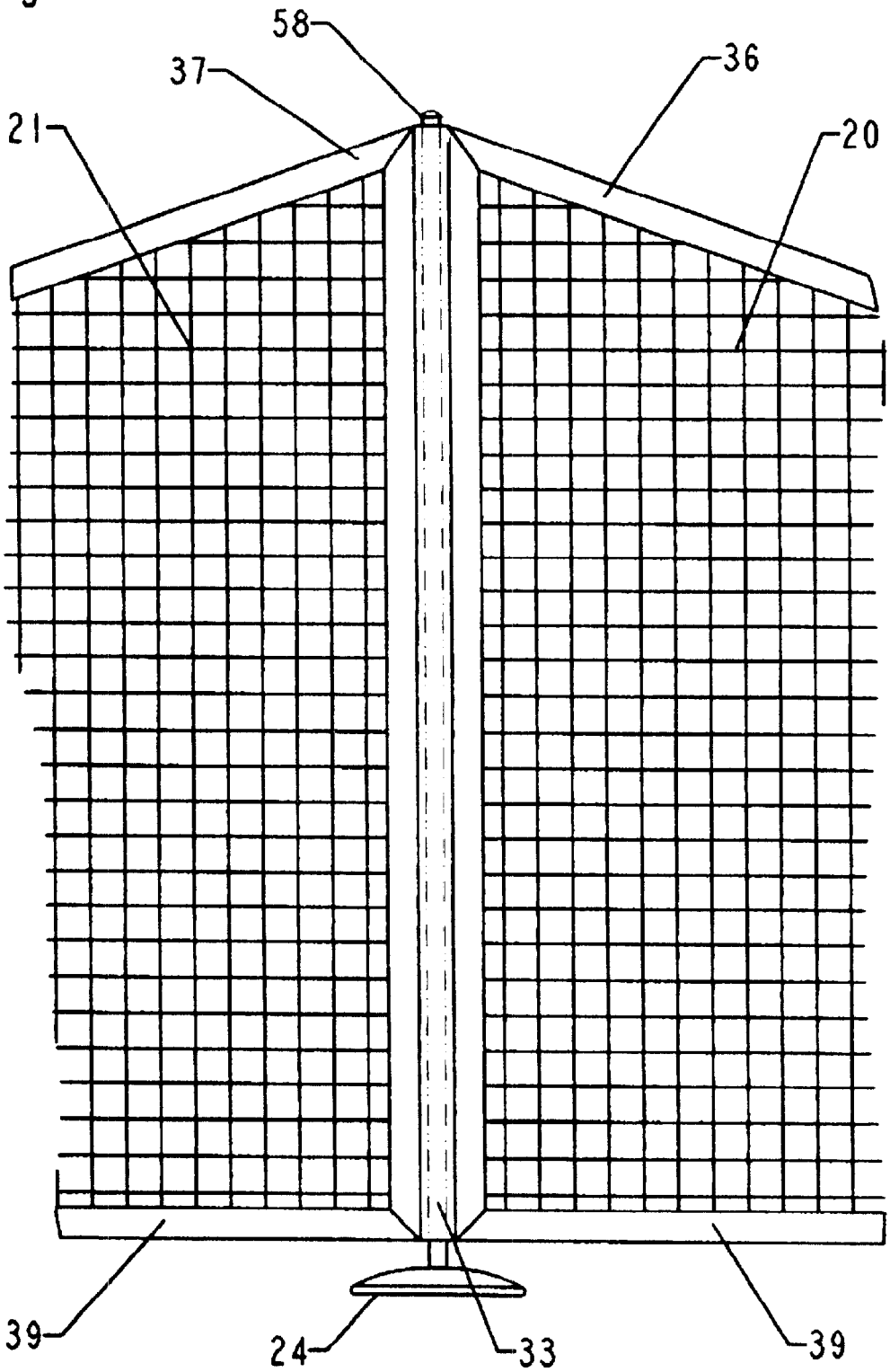
FIG. 13 is a partial break away view, shown in elevation, of the alternate embodiment wherein a vertical pole, mounted in a movable base, is connected to the two adjacent sections located behind the basketball goal post.
Figure 14:
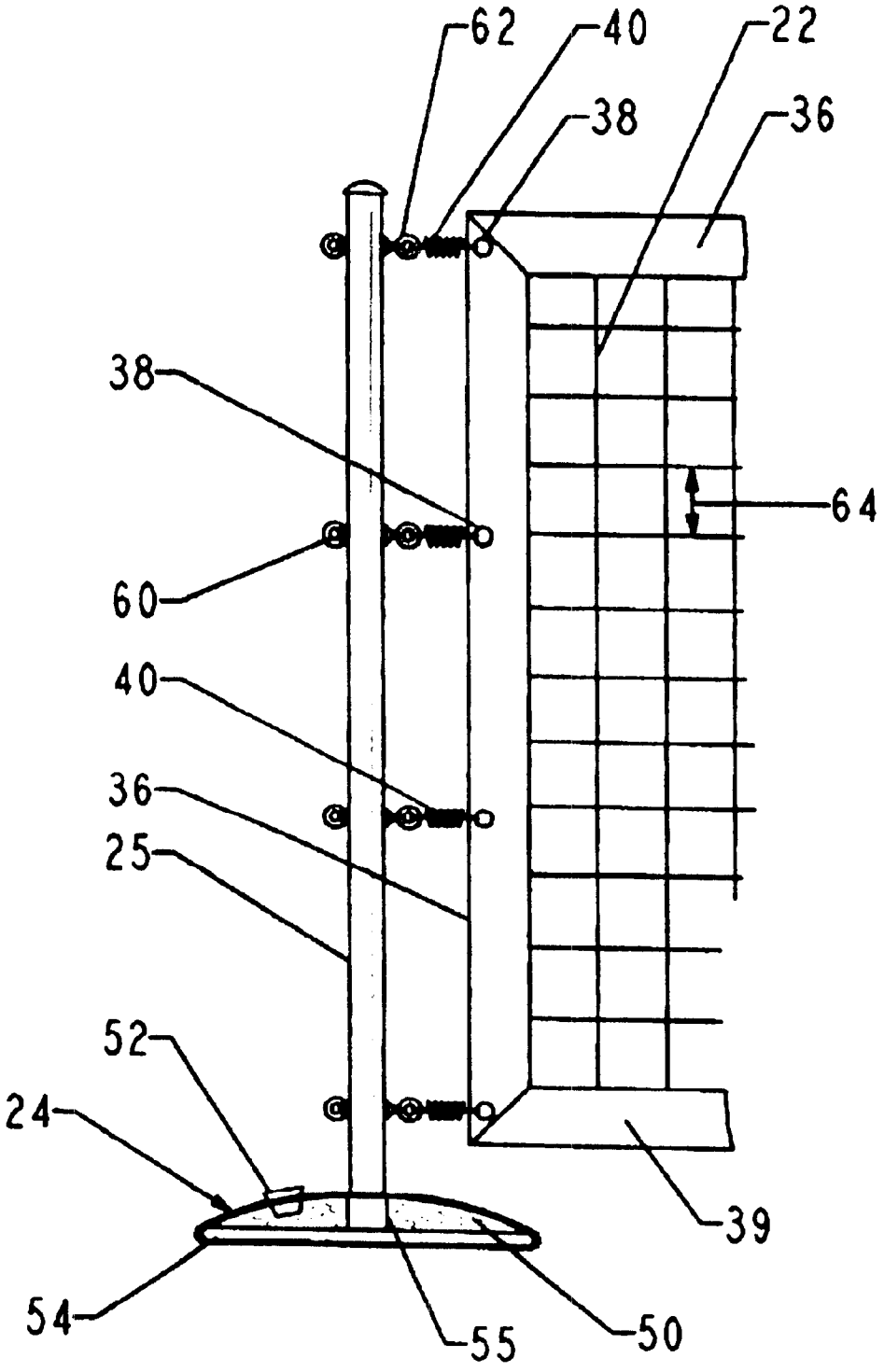
FIG. 14 is a partial break away view, shown in elevation, of the vertical pole, mounted in a movable base, is connected to the end of a single section by fasteners wherein the movable base is shown in cross section.

Sections of netting can be described as fabric mesh bordered by and sewn to strips of cloth forming borders 36, 37, and 39, on all four sides of the netting. Each section of netting 20, 21, and 22, is constructed with a top border 36, a vertical side border 37, and bottom border 39, of any suitable of material, FIGS. 3 through 8, and 13 through 17. Netting can be constructed of any light weight type of material. In this embodiment the mesh of the netting is made of polypropylene. The interstitial space 64 between threads of the mesh must not be greater than six (6) inches in order to stop a basketball, FIG. 14. The illustration of the netting and interstitial space between strands of netting, as shown in FIG. 14, is applicable for all netting in this invention, FIGS. 1, 3 through 8, and 13 through 17. Such material should be able to withstand elements of the weather since the basketball safety apparatus is intended to be used outside in all types of weather.

Vertical poles 25, 26, 27, and 58, can be constructed of any appropriate material. In this invention, they are contemplated to be constructed of 3-in. diameter, polyvinyl chloride (PVC), and approximately five-and-one-half-foot, lengths of piping. Vertical poles 25, 26, and 27 are comprised of single five-and-one-half-foot lengths of piping, FIGS. 1, 3, 4, 14, and 15. However, the vertical pole 58 located directly behind the basketball goal post would comprise two five-and-one-half-foot lengths of piping mated together by crimping an end of one and fitting it into the other by a male-female connection. It is designed to be connected and disconnected easily so this invention can be assembled and disassembled by a child. It should be understood that vertical poles 25, 26, and 27, could be comprised of two five-and-one-half-foot lengths of PVC piping, FIGS. 1, 3, 4, 14, and 15.

Figure 3:
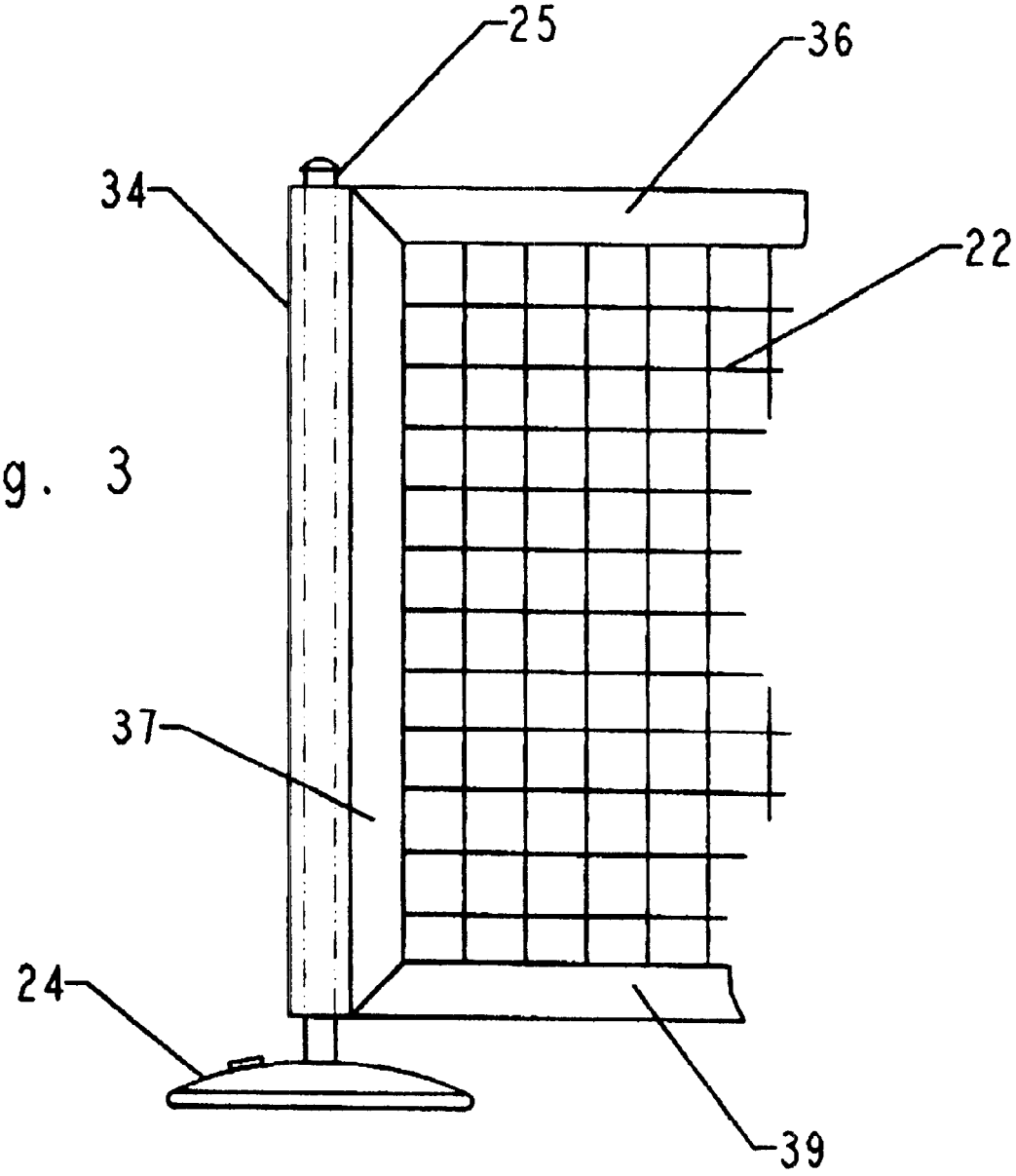
FIG. 3 is a partial break away view, shown in elevation, of the preferred embodiment wherein a vertical pole, mounted in a movable base, is connected to the end of a section of netting.
Figure 4:
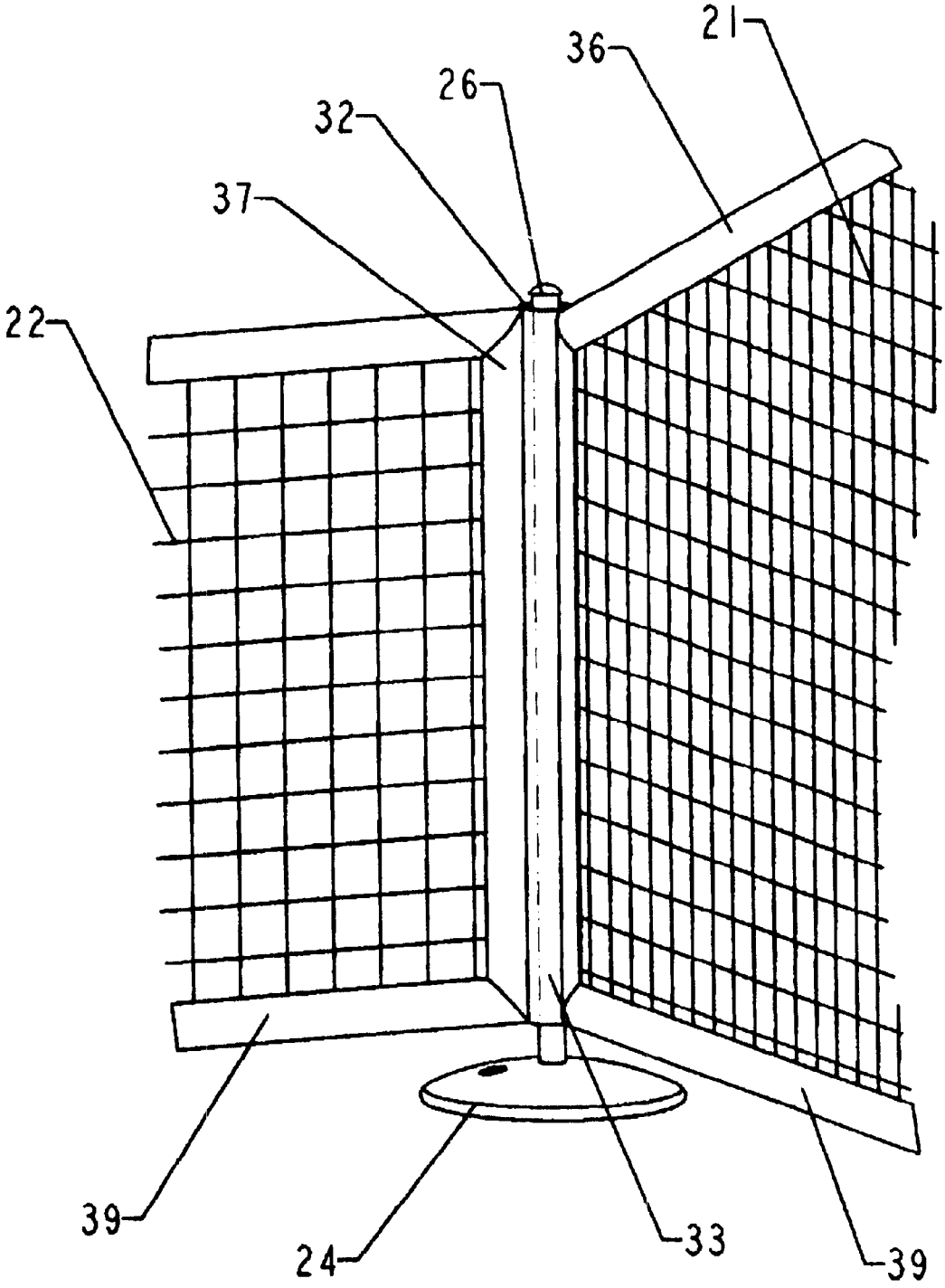
FIG. 4 is a partial break away view, shown in perspective, of the preferred embodiment wherein a vertical pole, mounted in a movable base, is connected to two adjacent sections of netting.
Figure 18:
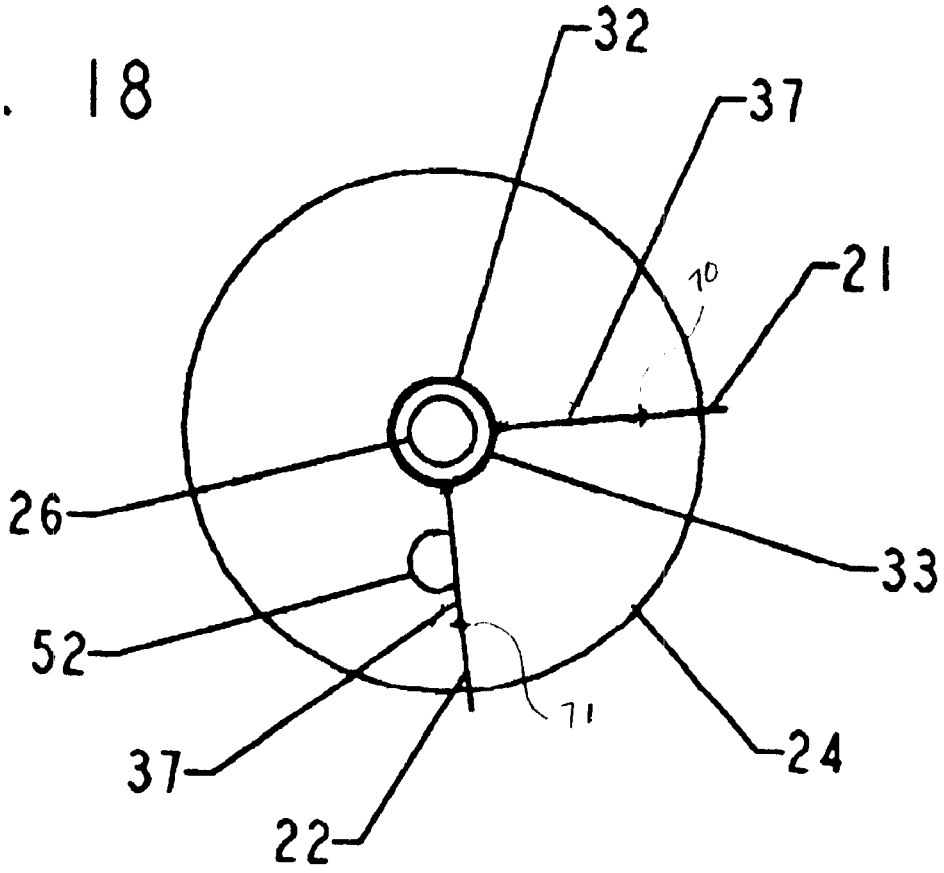
FIG. 18 is a partial break away top plan view of the vertical pole, mounted in a movable base, supporting and connected to the two adjacent sections of netting, as shown in FIG. 4.

In the preferred method of connecting vertical pole 26 to adjacent sections of netting, vertical side borders 37 are sewn to two rectangular strips of cloth 32 and 33 to form sleeves, FIG. 18, which fit over vertical pole 26 in order both to connect adjacent sections of netting 21 and 22 to each other and to attach the sections of netting to vertical pole 26, FIG. 4, for support. FIG. 4 shows vertical pole 26, mounted in a movable base 24, supporting and connected to the adjacent sections of netting 21 and 22, one 22 forming the barrier across the driveway and the other 21 forming the backdrop behind the basketball goal post, where the vertical side borders 37 of each said section of netting are sewn to a sleeve fitting over the vertically mounted pole 26. (Dotted lines show vertical pole 26 behind cloth 33, FIG. 4; cloth 32 is partially hidden from view.) FIG. 18 also shows the vertical pole 26, mounted in a movable base 24, supporting and connected to the adjacent sections of netting 21 and 22, one 22 forming the barrier across the driveway and the other 21 forming the backdrop behind the basketball goal post, where the vertical side borders 37 of each said section of netting are sewn to a sleeve fitting over the vertically mounted pole. The adjacent sections of netting 21 and 22 are connected to each other by strips of cloth 32 and 33 which form the sleeve to fit over vertical pole 26, FIG. 18. (Tick mark 70 shows the delimitation between vertical side border 37 and section of netting 21, FIG. 18, and tick mark 71 shows the delimitation between vertical side border 37 and section of netting 22.) The strips of cloth 32 and 33 can be constructed of any type of material strong enough to hold the adjacent sections of netting together, but also supple enough to fit over a vertical mounted base. Similarly, adjacent sections of netting 20 and 21 are connected to each other by strips of cloth which form the sleeve to fit over vertical pole 58, FIG. 13, in the alternate embodiment. FIG. 13 also shows strip of cloth 33 which, in combination strip with cloth 32, forms the sleeve which fits over vertical pole 58. Strip of cloth 32 is hidden from view, and dotted lines show vertical pole 58 behind strip of cloth 33. In addition, FIG. 13 shows the vertical pole 58, mounted in a movable base 24, supporting and connected to the adjacent sections of netting 20 and 21 that form the backdrop behind the basketball goal post 28 where the vertical side borders 37 of each said section of netting are also sewn to a sleeve fitting over the vertically mounted pole 58. In both FIGS. 4 and 13, strip of cloth 33 is visible, but strip of cloth 32 is hidden. It should be understood that, when adjacent sections of netting 20 and 21 both are connected to and supported by the basketball goal 28, said adjacent sections of netting 20 and 21 will be attached to each other by sleeves, but will be connected to the basketball goal post 28 by other means described below, FIGS. 5 through 8. Dotted lines show goal post 28 behind strips of cloth 32 and 33, (strip of cloth 33 would be hidden from view), FIGS. 5–7; in this case, strips of cloth 32 and 33 are not used to form a sleeve. At the extreme end point of section of netting 22 where said section of netting is connected to and supported by vertical pole 25, a single rectangular strip of cloth 34 of sufficient width is sewn to the vertical side border 37 of section of netting 22 to fit over vertical pole 25, FIG. 3. FIG. 3 shows the vertical pole 25, mounted in a movable base 24, supporting and connected to one end of the section of netting 22 which forms a barrier across a driveway showing the vertical side border 37 of the section of netting 22 sewn to a sleeve fitting over the vertically mounted pole 25. Similarly, FIG. 3 represents and shows the method by which section of netting 20 is connected to and supported by vertical pole 27; i.e., by a single rectangular strip of cloth to fit over vertical pole 27, FIG. 1. Dotted lines show vertical pole 25 within sleeve 34 which fits over vertical pole 25, FIG. 1.

Figure 5:
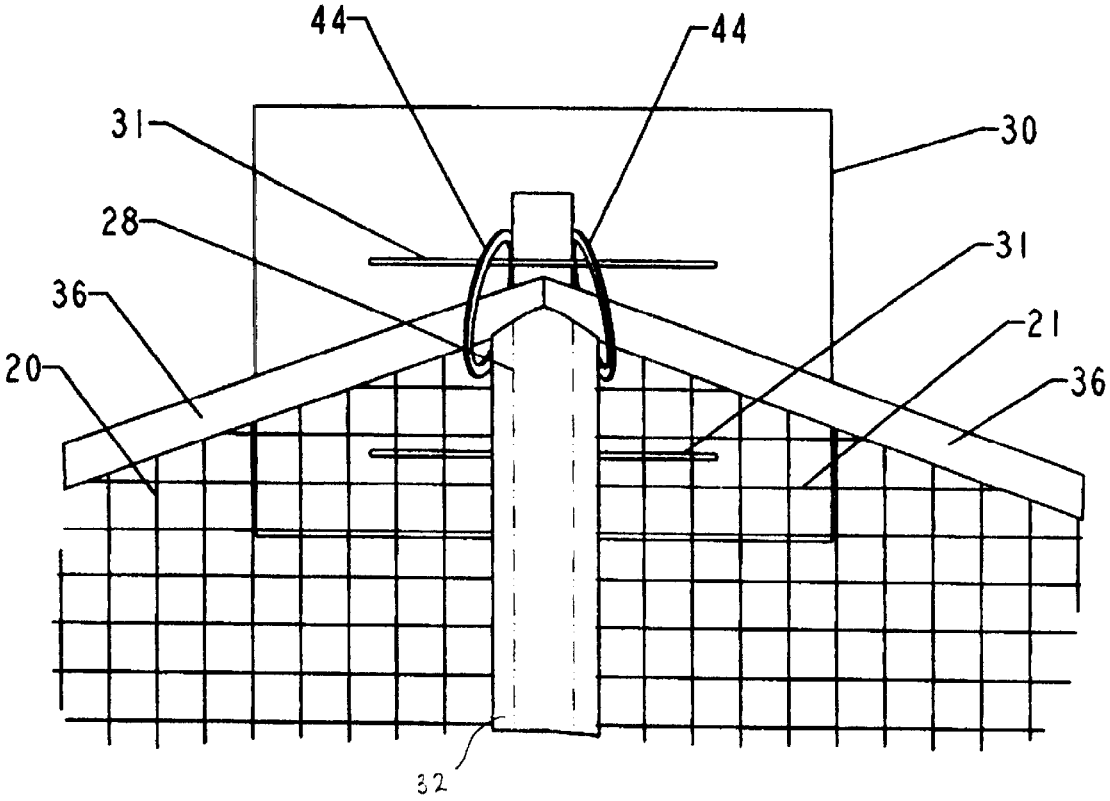
FIG. 5 is a partial break away rear view, shown in elevation, of two adjacent sections of netting connected to the basketball goal post by C-hooks.
Figure 6:
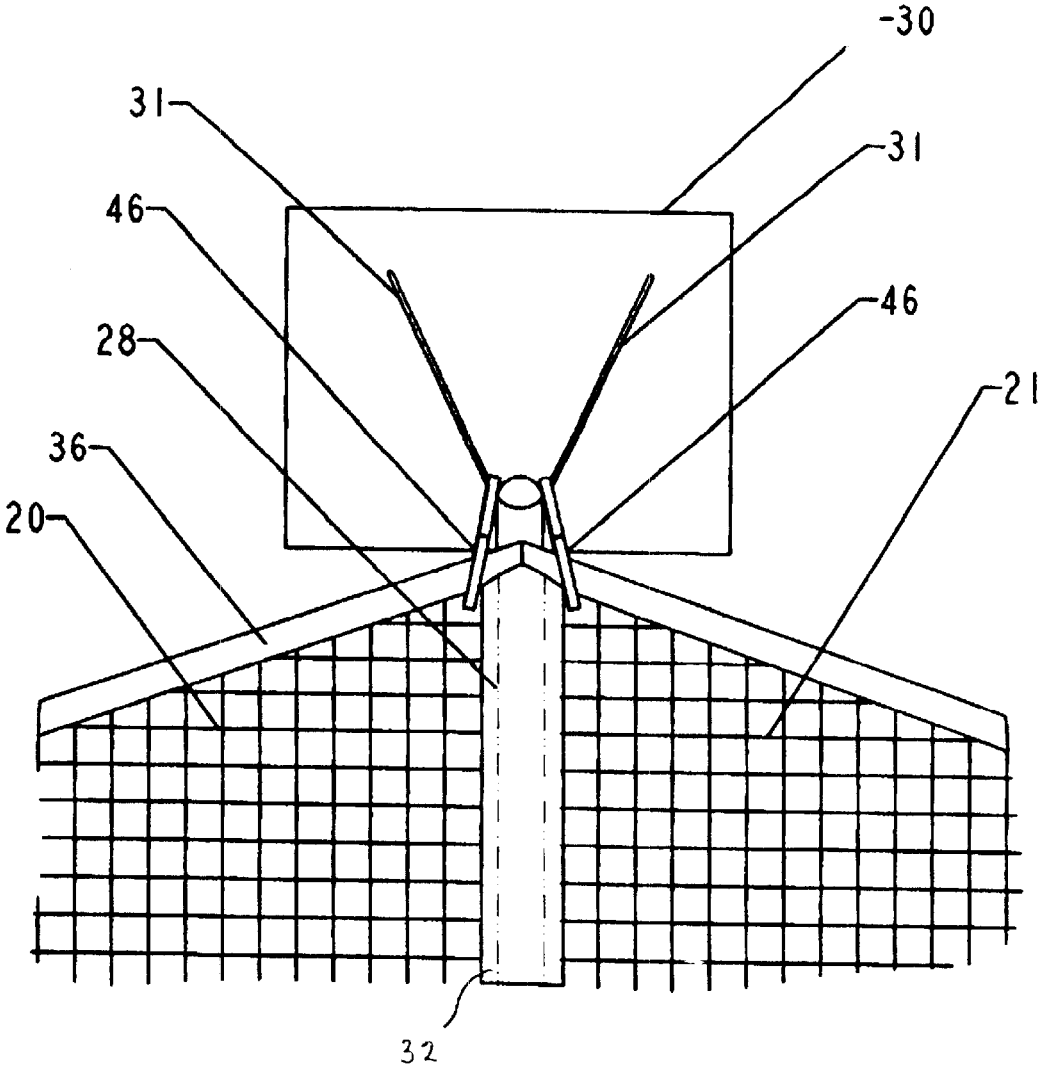
FIG. 6 is a partial break away rear view, shown in elevation, of the two adjacent sections of netting connected to the basketball goal post by strips of hook-and-loop material.
Figure 7:
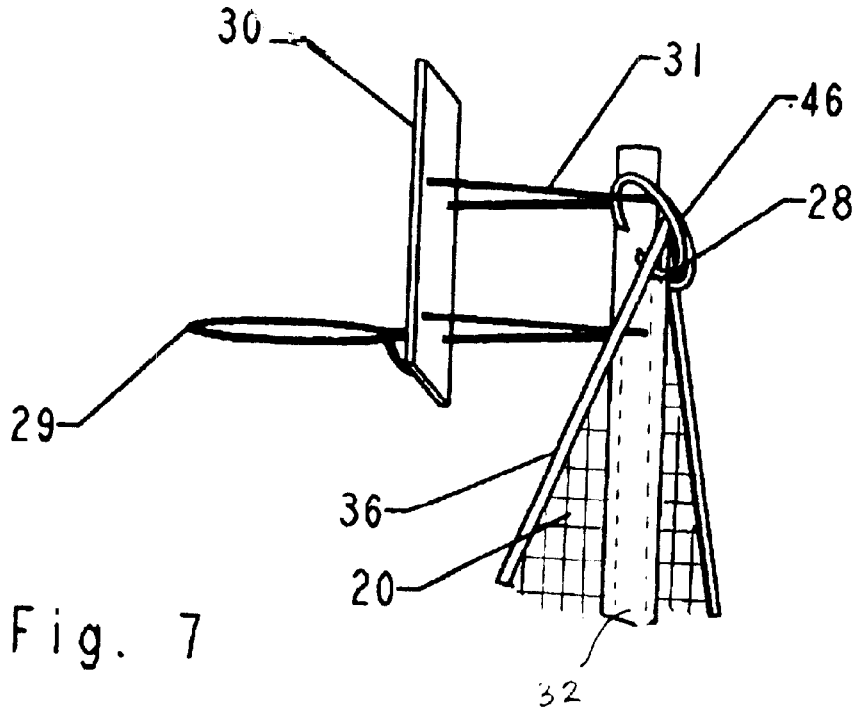
FIG. 7 is a partial break away side view, shown in perspective, of the basketball goal post supporting and connected to the sections of netting, as shown in FIG. 5.
Figure 8:
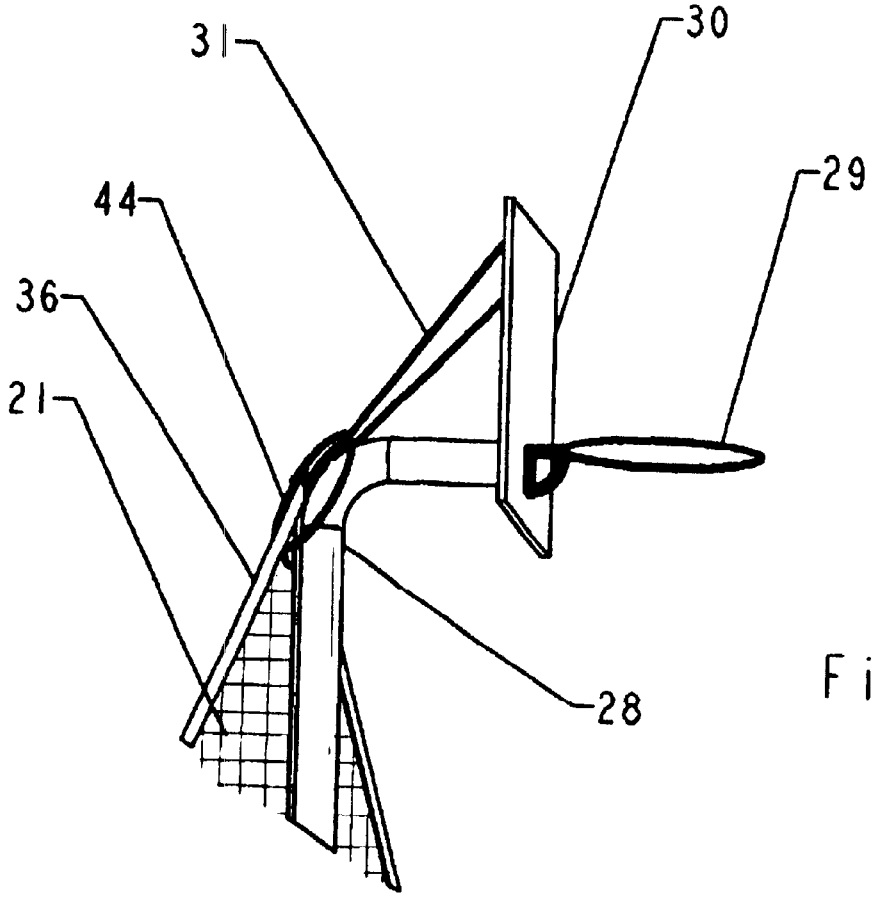
FIG. 8 is a partial break away side view, shown in perspective, of the basketball goal post supporting and connected to the sections of netting, as shown in FIG. 6.
Figure 9:
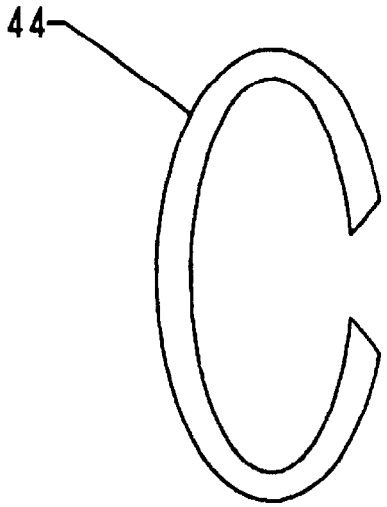
FIG. 9 is an elevation of a C-hook.
Figure 10:
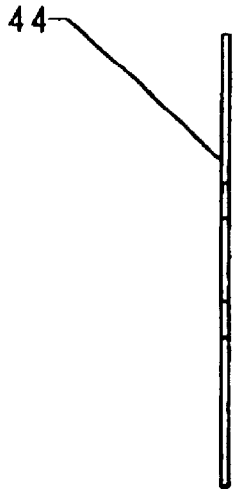
FIG. 10 is a right side elevation of the C-hook.
Figure 11:
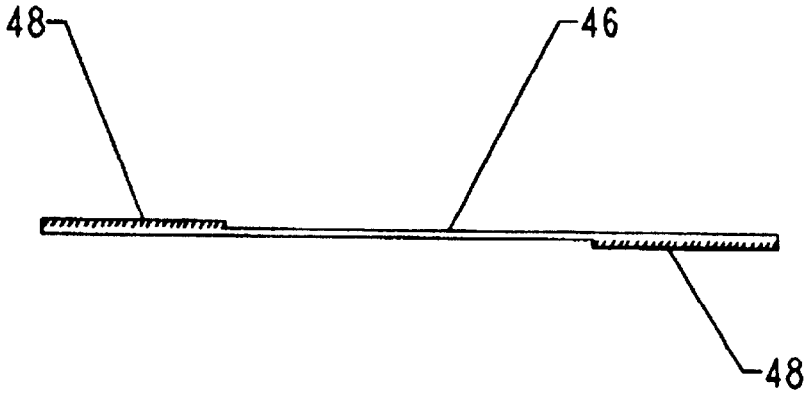
FIG. 11 is an elevation of a strip of hook-and-loop material, as shown in FIG. 6.

In the preferred embodiment, the sections of netting 20 and 21 forming the backdrop behind the goal post 28, attached by strips forming the sleeve which could have fit over a vertically mounted pole, are connected to vertical support bars 31 attached to the back of the backboard 30 of the post 28 by means of C-hooks 44, FIGS. 5 and 7. Strips of hook-and-loop material 46 can also be used to attach such sections of netting 20 and 21 to the vertical support bars 31, FIGS. 6 and 8; lengths of rope (not shown) could also be used. C-hooks 44 are made of any rigid material such as plastic, pregalvanized steel, or aluminum dipped in rubber FIGS. 9 and 10. Strips 46 of hook-and-loop material are between eight to twelve (8–12) inches in length, FIG. 11. FIG. 11 shows hook-and-loop material 48 attached to cloth 46. FIGS. 5 and 6 show typical representative mountings of backboards 30 to goal posts 28. These are not the only types of mountings of backboards and goal posts to which this invention could apply. The C-hook 44, strips 46 of hook-and-loop material, or lengths of rope need only hook over any vertical support bar between the backboard and the goal post. It should be understood that S-shaped hooks or any other shape hook could be used in addition to C-shaped hooks to attach the sections of netting 20 and 21 to the basketball goal post 28.

Figure 12:
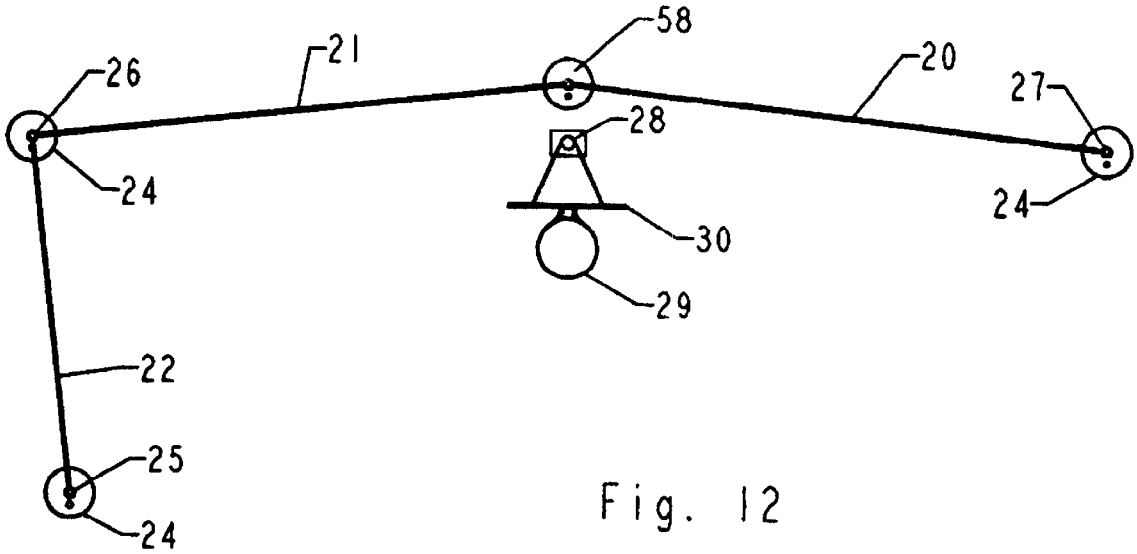
FIG. 12 is a schematic plan view of an alternate embodiment of the basketball safety apparatus where the netting forming the backdrop behind the basketball goal post is supported by and connected to another vertically mounted pole.
Figure 17:
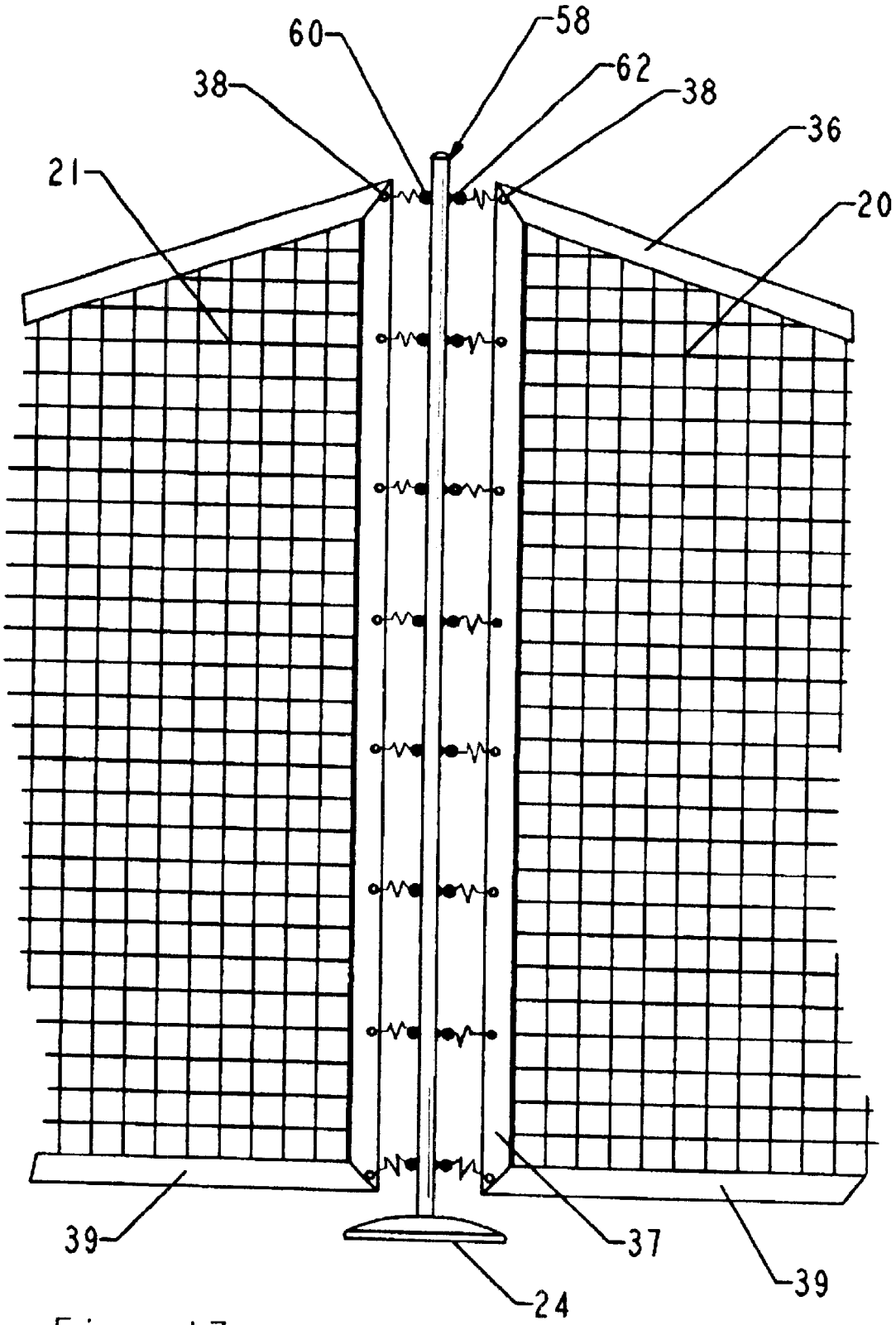
FIG. 17 is a partial break away view, shown in elevation, of the alternate embodiment wherein the two adjacent sections of netting forming a backdrop behind the basketball goal post are connected to a vertically mounted pole by fasteners.

In the alternative embodiment, if it is desired to locate the sections of netting 20 and 21 further behind the basketball goal post 28, said adjacent sections of netting 20 and 21 forming the backdrop behind the basketball goal post 28 are fitted over another vertical pole 58 mounted in a movable base 24 located behind the basketball goal post, FIGS. 12, 13, and 17.

Figure 15:
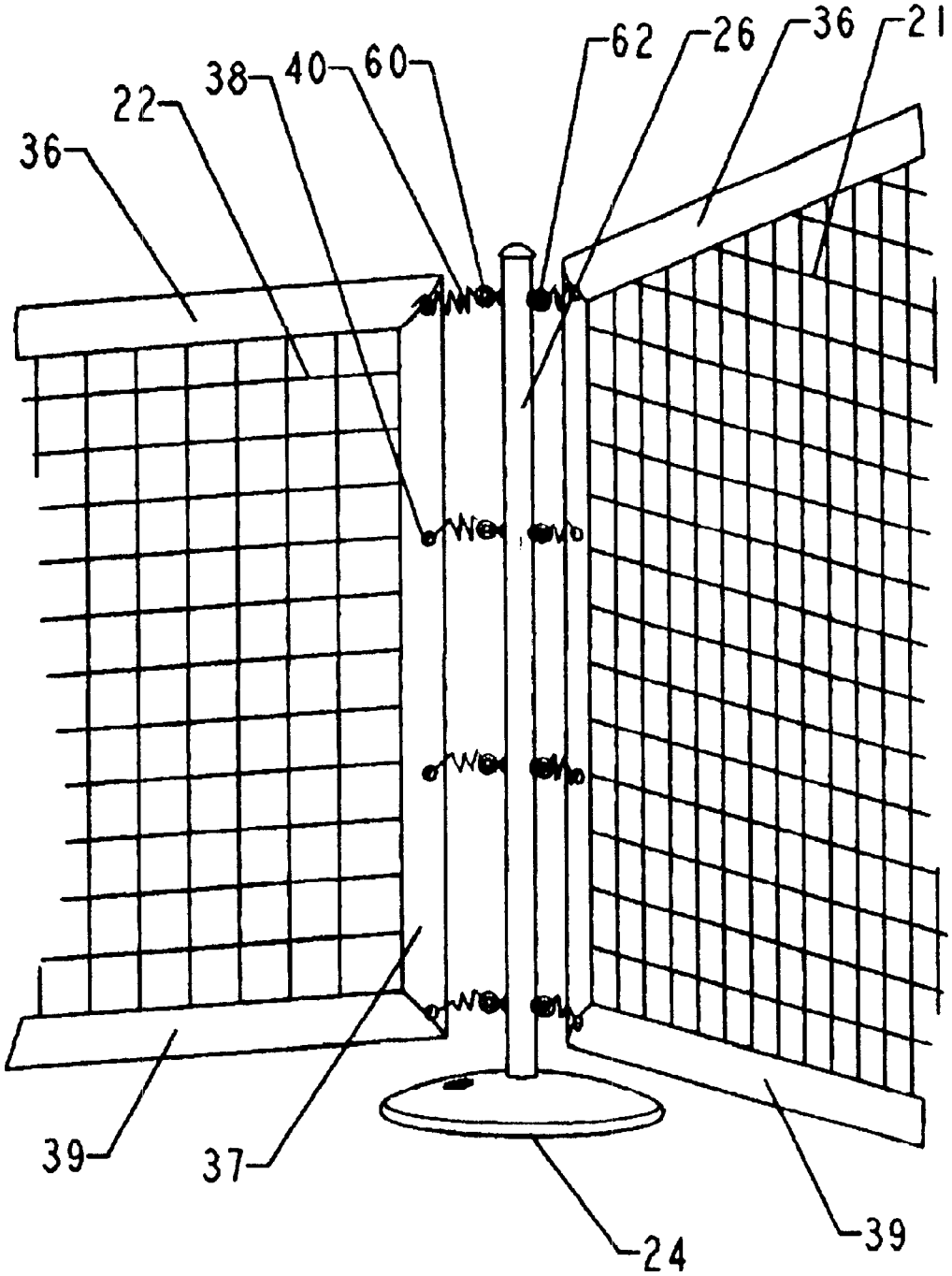
FIG. 15 is a partial break away view, shown in perspective, of a vertical pole, mounted in a movable base, connected to two adjacent sections of netting by fasteners.
Figure 16:
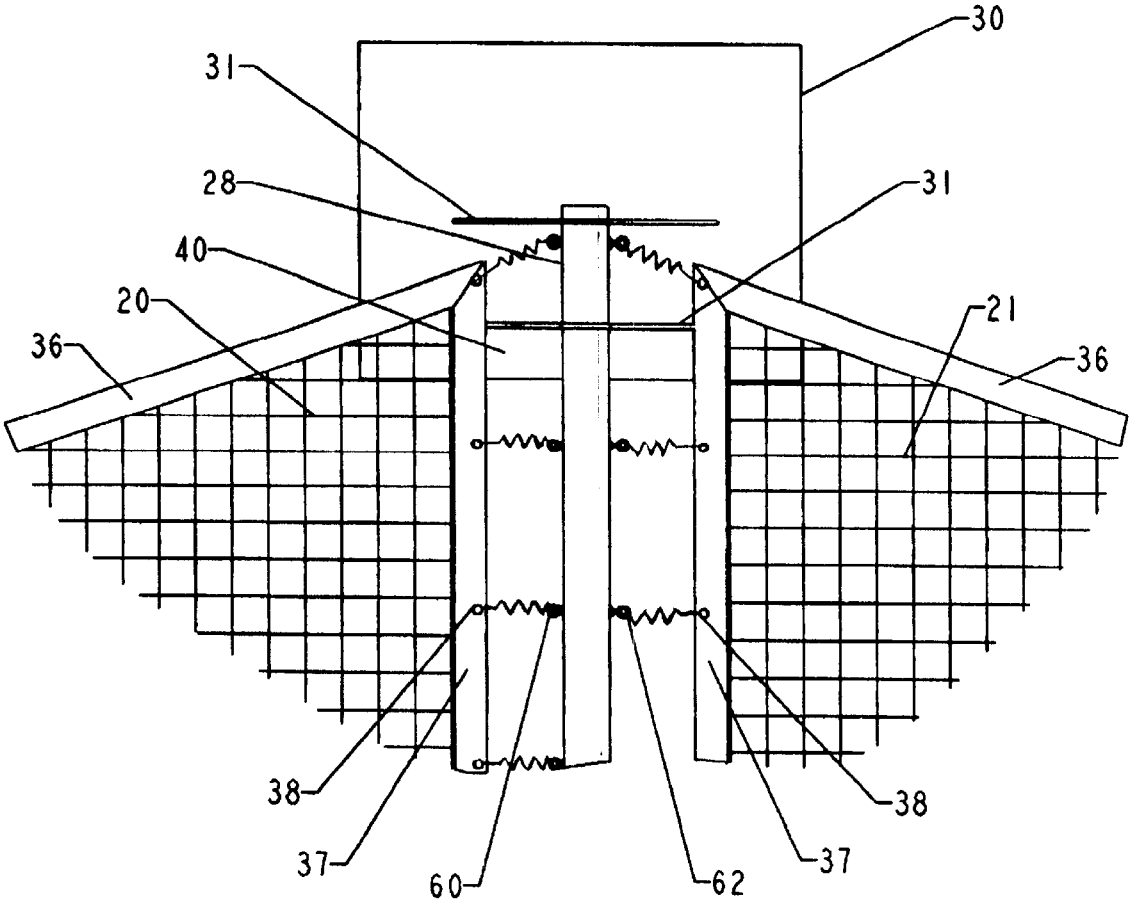
FIG. 16 is a partial break away view, shown in elevation, of the preferred embodiment wherein the two adjacent sections of netting forming a backdrop behind the basketball goal post are connected to the basketball goal post by fasteners.
Figure 19:
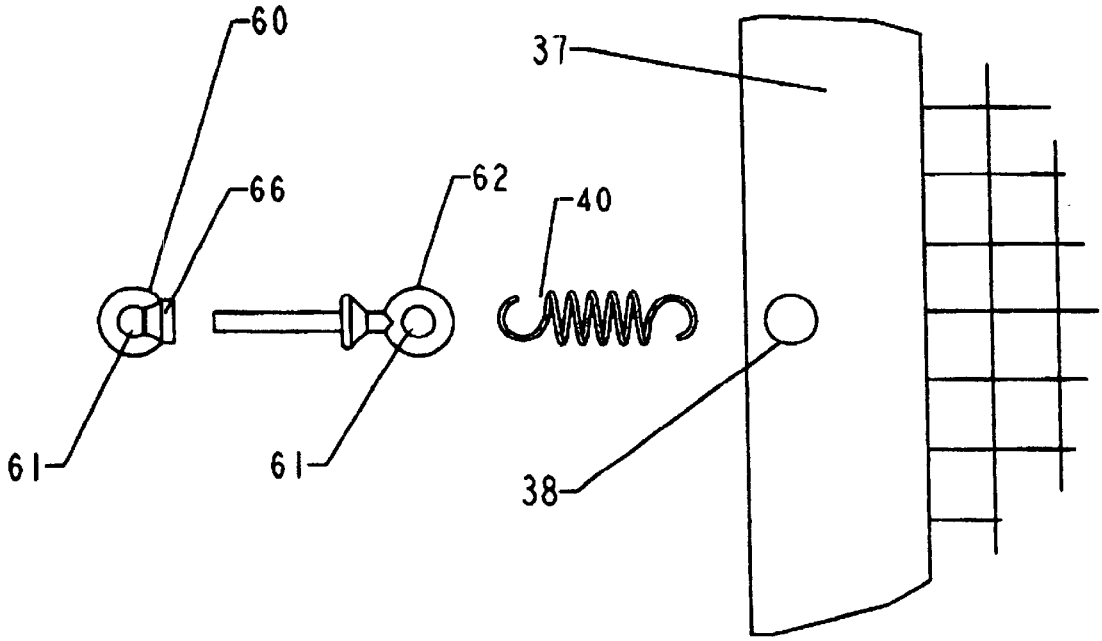
FIG. 19 is an exploded view of an eyenut-and-eyebolt assembly fastener.

Another method of connecting sections of netting to vertical poles involves the use of fasteners, FIGS. 14 through 17. Fasteners in the form of eyebolts 62 and eyenuts 60 are inserted through holes drilled through the vertical poles 25, 26, and 58, FIGS. 14, 15, and 17, or inserted through holes drilled through the basketball goal post 58 itself, FIG. 16. It should be understood that FIG. 14 is representative of the method of securing section of netting 20 to vertical pole 27 if eyebolts and eyenuts are desired. The eyebolts 62 are secured to the poles or goal post by screwing an eyenut 60 onto the end of said eyebolt 62, shown in FIG. 19. FIG. 19 shows an exploded view of an eyenut 60, as it would be connected to an eyebolt 62, as it would be connected to a hook-spring 40, as it would be connected to a grommet 38 located in the vertical side border 37 of a section of netting. One end of hook-spring 40 loops through the eye 61 of eyebolt 62; the other end of hook-spring 40 loops through a grommet 38 installed on vertical side border 37, FIG. 19. For connecting adjacent sections of netting, one end of a hook-spring would loop through the eye of an eyenut; the other end of the hook-spring would loop through a corresponding grommet installed on the vertical side border of the adjacent section of netting, not shown. For this method of connecting sections of netting either to vertical poles 25, 26, 27, or 58, or to the basketball goal post 28, a plurality of grommets 38 are installed into the vertical side borders 37 of sections of netting, FIGS. 14 through and 17. Hook-springs 40 connect each eyebolt 62 or corresponding eyenut 60 to a corresponding grommet 38 to attach the sections of netting to the vertical poles or the basketball goal post, FIGS. 14 through 17. FIG. 14 shows the vertical pole 25 mounted in a movable base 24 supporting and connected to the end of the section of netting 22 forming a barrier across the driveway where the vertical side border 37 of section of netting 22 is attached to the vertically mounted pole 25 by fasteners. Fasteners are in the form of eyenuts 60 which are screwed onto eyebolts 62 through holes drilled through vertical pole 25; one end of a hook-spring 40 hooks through the eye 61 of eyebolt 62 or an eyenut 60 while the other end of the hook-spring 40 hooks through a grommet 38 in the vertical side border 37 of a section of netting, FIGS. 14 through 17, and 19. FIG. 15 shows the vertical pole 26, mounted in a movable base 24, supporting and connected to adjacent sections of netting 21 and 22, one 22 which forms the barrier across the driveway and the other 21 which forms the backdrop behind the basketball goal post. There are a plurality of hook-springs 40, wherein one end of each connects either to an eyenut 60 or to a corresponding eyebolt 62, to vertical pole 26, and the other end connects to a corresponding grommet 38 secured within a vertical side border 37 of either of the sections of netting 21 or 22, FIG. 15. Similarly, FIG. 16 shows adjacent sections of netting 20 and 21 forming the backdrop behind the basketball backboard 30 where vertical side borders 37 of said sections of netting 20 and 21 are attached to the basketball goal post 28 by means of hook-springs 40, eyenuts 60, and eyebolts 62, in the preferred embodiment. Further, FIG. 17 shows adjacent sections of netting 20 and 21 forming the backdrop behind the basketball backboard 30 where vertical side borders 37 of said sections of netting 20 and 21 are attached to vertical pole 58 by means of hook-springs 40, eyenuts 60, and eyebolts 62, in the alternate embodiment. In such case, assembling the basketball safety apparatus would be considered permanent in nature in that the user would have to unscrew each individual fastener in order to disassemble the apparatus which would be tedious and time-consuming. The embodiment where sleeves are employed both to connect sections of netting together and attach same to vertical poles would be considered temporary or removable in nature.

Vertical poles 25, 26, 27, and 58, which support and connect sections of netting 20, 21, and 22, are adapted to be mounted and held in place by movable support bases 24, FIG. 1. FIG. 14 shows that a movable base 24 is a discus-shaped container 54 constructed with a recess 55 such that the lower end of vertical pole 25 fits into said recess 55 in order to hold and support vertical pole 25. Each movable base 54 is designed to be filled with ballast for weight and support. Ballast 50 can be sand, water, or any other suitable material, FIG. 14. Ballast is introduced into the container 54 by means of an opening 52, FIG. 14. It should be understood that the movable base 24 shown in FIG. 14 is representative of any movable base required by this invention, FIGS. 3, 4, 13, 15, and 17.

It is intended that this invention be offered for sale in a kit for assembling this basketball safety structure. In the pre-formed embodiment, the kit would include three vertical poles 25, 26, and 27, three movable bases 24, sections of netting 20, 21, and 22 (all attached to each other by rectangular cloths forming sleeves to fit over the vertical poles), and either two C-hooks or two strips of hook-and-loop material. In the alternate embodiment, the kit would include an additional vertical pole and movable base when it is desired to locate the netting forming the backdrop further behind the basketball goal post. In another embodiment, the kit would include three vertical poles, three movable bases, and three separate sections of netting (one rectangular in shape 20 and two trapezoidal in shape 21 and 22), and a sufficient number of fasteners to connect the sections of netting to the vertical poles and to a basketball goal post. And in still another embodiment, the kit would include the additional vertical pole and movable base, along with a sufficient number of fasteners when it is not desired to connect netting backdrop directly to the basketball goal post. It should be understood that the additional vertical pole would come in the form of two basic five-and-one-half-foot high lengths of PVC piping. However, the kit could include vertical poles of any height depending on market preference. It also should be understood that the basic kit would include one rectangular section of netting 22, approximately five-and-one-half feet by 12 feet, and two trapezoidal sections of netting 20 and 21, approximately 11 feet high at its maximum and approximately five-and-one-half feet at its minimum by 18 feet in length. However, the kit could include sections of netting of any height and width, again depending on market demand.

It should be understood that the drawings submitted herewith are not always drawn to exactly to scale, but all drawings submitted are presented to accurately illustrate the functional features of this invention.

While the present invention has been disclosed in connection with the preferred embodiment thereof, it should be understood that there may be other embodiments which fall within the spirit and scope of the invention as defined by the following claims.

We claim:

1. A basketball safety apparatus to be used in conjunction with a basketball hoop and backboard mounted on a basketball goal post, comprising:

sections of netting, quadrilateral in shape, sloping downwardly, from a maximum height slightly above the basketball hoop at or near the basketball goal post to a lesser height away from the goal post, each section having strips of cloth sewn to the four edges thereof forming borders therearound, said netting having a maximum interstitial space between strands thereof narrow enough to stop a basketball;

a plurality of movable pole support bases;

a plurality of poles adapted to be mounted vertically in the movable pole support bases;

a plurality of connectors for connecting the sections of netting to the vertically mounted poles; and the poles and bases being mounted and arranged such that the sections of netting form a barrier in two approximately orthogonal directions in which at least one section of netting forms a barrier across a driveway which connects to a street and other sections of netting form a backdrop behind the backboard of the basketball goal post.

2. A basketball safety apparatus according to claim 1, wherein the pole support bases are comprised of containers adapted to receive one end of the vertical mounted poles said containers being adapted to be filled with ballast.

3. A basketball safety apparatus according to claim 2, wherein the ballast is sand.

4. A basketball safety apparatus according to claim 2, wherein the ballast is water.

5. A basketball safety apparatus according to claim 1, wherein the vertically mounted poles are comprised of lengths of polyvinyl chloride pipe (PVC) pipe approximately five-and-one-half feet long wherein said lengths may be readily joined for assembly.

6. A basketball safety apparatus according to claim 1, wherein the sections of netting are removably connected to the vertically mounted poles by two rectangular strips of cloth each sewn to the vertical side borders of two adjacent sections of netting forming a sleeve adapted to slide over a vertically mounted pole when connecting two adjacent sections of netting to a pole situate therebetween.

7. A basketball safety apparatus according to claim 1, wherein the sections of netting are removably connected to the vertically mounted poles by a single rectangular piece of cloth whose vertical parallel edges are both sewn to a vertical side border of a section of netting forming a sleeve adapted to slide over a pole when connecting a section of netting to a pole situate at the end of said section of netting.

8. A basketball safety apparatus according to claim 1, wherein the sections of netting are connected to the vertically mounted poles by a plurality of fasteners and wherein there are a plurality of grommets installed in the vertical side borders of each said section of netting.

9. A basketball safety apparatus according to claim 1, wherein the two sections of netting at or near the location of maximum height forming the backdrop behind the backboard are removably connected to the basketball goal post by C-hooks, one end of each C-hook hung over a vertical support bar of the goal post and the other end hooked under the top border of a section of said netting.

10. A basketball safety apparatus according to claim 1, wherein the two sections of netting at or near the location of maximum height forming the backdrop behind the backboard are removably connected to the basketball goal post by strips of hook-and-loop material, each strip of hook-and-loop material looped over a vertical support bar of the goal post and under the top border of a section of said netting.

11. A basketball safety apparatus according to claim 8, wherein each fastener comprises an eyenut, an eyebolt, and a hook-spring wherein the eyenut is connected to the eyebolt through an opening drilled through a vertically mounted pole, the eye of said eyebolt is attached to one end of a first hook-spring, the other end of the first hook-spring is attached to a grommet secured to the vertical side border of one of two adjacent sections of netting, the eye of said eyenut is connected to one end of a second hook-spring, and the other end of the second hook-spring is attached to a grommet secured to the vertical side border of the other of the two adjacent sections of netting, when connecting two adjacent sections of netting to a vertical pole situate therebetween.

12. A basketball safety apparatus according to claim 8, wherein each fastener comprises an eyenut, an eyebolt, and a hook-spring wherein each the eyenut is connected to the eyebolt through an opening drilled through a vertically mounted pole, the eye of said eyebolt is attached to one end of a hook-spring, the other end of the hook-spring is attached to a grommet secured to the vertical side border of a section of netting, when connecting a vertical pole to a single section of netting.

13. A basketball safety apparatus according to claim 1, wherein the sections of netting forming the backdrop behind the backboard are connected to and supported by the basketball goal post by fasteners, each fastener comprises an eyenut, an eyebolt, and a hook-spring wherein each eyenut is connected to an eyebolt through an opening drilled through the basketball goal post, the eye of said eyebolt is attached to one end of a first hook-spring, the other end of the first hook-spring is attached to a grommet secured to the vertical side border of one of two adjacent sections of netting, the eye of said eyenut is connected to one end of a second hook-spring, and the other end of the second hook-spring is attached to a grommet secured to the vertical side border of the other of the two adjacent sections of netting, when connecting two adjacent sections of netting to the basketball goal post, situate therebetween.

14. A kit for assembling a basketball safety structure, the kit to be assembled for use in connection with a basketball hoop and backboard mounted at a height on a basketball goal post in proximity to a driveway which connects to a street, comprising:

a plurality of sections of netting, quadrilateral in shape, said plurality of sections including two sections each having opposite ends and which slope in height from a maximum height at least about equal to the height of the basketball hoop at one end to a lesser height at the opposite end, each section having strips of cloth sewn to the four edges thereof forming borders therearound, said netting having a maximum interstitial space between strands thereof narrow enough to stop a basketball;

a plurality of movable pole support bases;

a plurality of poles adapted to be mounted vertically in the movable pole support bases;

a plurality of connectors for connecting the sections of netting to the vertically mounted poles; and the poles, bases, and sections of netting being adapted to be mounted and arranged such that the sections of netting form a barrier in two approximately orthogonal directions in which at least one section of netting forms a barrier across the driveway which connects to the street and the two sections of netting being arranged and located with their vertical borders of maximum height substantially together to form a backdrop behind the backboard of the basketball goal post.

15. A kit for assembling a basketball safety apparatus according to claim 14, wherein the pole support bases are comprised of containers adapted to receive one end of the vertical mounted poles said containers being adapted to be filled with ballast.

16. A kit for assembling a basketball safety apparatus according to claim 14, wherein the vertically mounted poles are comprised of lengths of polyvinyl chloride pipe (PVC) pipe approximately five-and-one-half feet long wherein said lengths may be readily joined for assembly.

17. A kit for assembling a basketball safety apparatus according to claim 14, wherein the sections of netting are adapted to be removably connected to the vertically mounted poles by two rectangular strips of cloth each sewn to the vertical side borders of two adjacent sections of netting forming a sleeve adapted to slide over a vertically mounted pole when connecting two adjacent sections of netting to a pole situate therebetween.

18. A kit for assembling a basketball safety apparatus according to claim 14, wherein the sections of netting are adapted to be removably connected to the vertically mounted poles by a single rectangular piece of cloth whose vertical parallel edges are both sewn to a vertical side border of a section of netting forming a sleeve adapted to slide over a pole when connecting a section of netting to a pole situate at the end of said section of netting.

19. A kit for assembling a basketball safety apparatus according to claim 14, wherein the two sections of netting at or near the location of maximum height forming the backdrop behind the backboard are adapted to be removably connected to the basketball goal post by C-hooks, one end of each C-hook hung over a vertical support bar of the goal post and the other end hooked under the top border of a section of said netting.

20. A kit for assembling a basketball safety apparatus according to claim 14, wherein the two sections of netting at or near the location of maximum height forming the backdrop behind the backboard are adapted to be removably connected to the basketball goal post by strips of hook-and-loop material, each strip of hook-and-loop material looped over a vertical support bar of the goal post and under the top border of a section of said netting.

21. A kit for assembling a basketball safety structure, the kit to be assembled for use in connection with a basketball hoop and backboard mounted at a height on a basketball goal post in proximity to a driveway which connects to a street, comprising:

a plurality of sections of netting, quadrilateral in shape, said plurality of sections including two sections each having opposite ends and which slope in height from a maximum height at least about equal to the height of the basketball hoop at one end to a lesser height about one-half the maximum height at the opposite end and at least one additional section of height about one-half the maximum height, each section having strips of cloth sewn to the four edges thereof forming borders therearound, said netting having a maximum interstitial space between strands thereof narrow enough to stop a basketball;

a plurality of movable pole support bases;

a plurality of poles adapted to be mounted vertically in the movable pole support bases;

a plurality of connectors for connecting the sections of netting to the vertically mounted poles; and the poles, bases, and sections of netting being adapted to be mounted and arranged such that the sections of netting form a barrier in two approximately orthogonal directions in which at least the at least one additional section of netting forms a barrier across the driveway which connects to the street and the two sections of netting being arranged and located with their ends of maximum height substantially together to form a backdrop behind the backboard of the basketball goal post.

* * * * *